US005857660A

United States Patent [19]

Lentine

[11] Patent Number: 5,857,660

[45] Date of Patent: Jan. 12, 1999

[54] PORTABLE OUTBOARD MOTOR SUPPORT AND LIFT

[76] Inventor: Salvatore A. Lentine, 3 Lentine Dr., Flemington, N.J. 08222

[21] Appl. No.: 848,507

[22] Filed: Apr. 28, 1997

Related U.S. Application Data

[63] Continuation-in-part of Ser. No. 658,396, Jun. 5, 1996, Pat. No. 5,662,307.

[51] Int. Cl.[6] ..... F16M 1/00

[52] U.S. Cl. ..... 248/640

[58] Field of Search ..... 248/640, 641, 248/642, 648, 676, 669, 664, 158, 162.1, 188.4, 176.1, 123.11, 123.2

[56] References Cited

U.S. PATENT DOCUMENTS

| | | | |
|---|---|---|---|
| 2,602,615 | 7/1952 | Maynard et al. | 248/676 |
| 3,412,813 | 11/1968 | Johnson | 173/141 |
| 4,646,996 | 3/1987 | Comstock | 248/165 |
| 4,673,358 | 6/1987 | Iwai | 440/61 |
| 4,682,961 | 7/1987 | Nakahama | 440/61 |
| 4,813,897 | 3/1989 | Newman | 440/61 |
| 5,746,404 | 5/1998 | Merko | 248/123.11 |

*Primary Examiner*—Leslie A. Braun
*Assistant Examiner*—Gwendolyn Baxter

[57] ABSTRACT

An improved portable outboard motor support and lift. The base further has a base exterior cylinder securely attached at a bottom end thereto. A base interior cylinder is movably positioned within the base exterior cylinder. The base interior cylinder further has a base interior cylinder motor mount securely attached at an upper distal end. The improved portable outboard motor support and lift has a first jack, a first jack piston securely attached to the base interior cylinder, and a first jack base securely attached to the base exterior cylinder. The improved portable outboard motor support and lift further has a lift which has a lift exterior cylinder having at least one lift exterior cylinder opening therethrough. The lift exterior cylinder is securely attached at a lower end to the base. The lift further has a lift interior cylinder having at least one lift interior cylinder upper opening and at least one lift interior cylinder lower opening therethrough. The lift interior cylinder is movably positioned within the lift exterior cylinder. An inner distal end of a lift arm exterior cylinder is pivotally mounted to the lift interior cylinder. The lift arm exterior cylinder has a lift motor attachment means. An outboard engine is attached to a lower end of the lift motor attachment means. A second jack has a second jack piston and a second jack base.

19 Claims, 2 Drawing Sheets

PORTABLE OUTBOARD MOTOR SUPPORT AND LIFT

CROSS REFERENCE TO RELATED APPLICATIONS

This application is a continuation-in-part of the application Ser. No. 08/658,396 filed on Jun. 5, 1996 titled Portable Outboard Motor Support and Lift, now U.S. Pat. No. 5,662,307.

BACKGROUND OF THE INVENTION

1. Field of the Invention

The present invention relates to portable outboard motor stands. More particularly, the present invention relates to portable outboard motor stands which also have the functionability as a lifting means.

2. Description of the Prior Art

Outboard motor supports are well known in the art. Outboard motor lifts are described in the prior art. Even though these innovations may be suitable for the specific individual purposes to which they address, they would not be suitable for the purposes of the present invention as heretofore described. However, presently there are no portable outboard motor support and lifts and therefore a need currently exists for such an item.

SUMMARY OF THE INVENTION

The present invention relates to portable outboard motor stands. More particularly, the present invention relates to portable outboard motor stands which also have the functionability as a lifting means.

The types of problems encountered in the prior art are outboard motor stands are configured with limited functionability to lift an outboard motor off a transom of a boat.

In the prior art, unsuccessful attempts to solve this problem were attempted namely: hydraulic outboard motor lifts which cradle the motor causing damage to the cover. However, the problem was solved by the present invention because the portable outboard motor support and lift emulates a boat transom and fastens onto the outboard motor with fasteners such as bolts.

Innovations within the prior art are rapidly being exploited in the field of ergodynamically designed lifts.

The present invention went contrary to the teaching of the art which describes hydraulically powered cradled outboard motor lifts.

The present invention solved a long felt need for a portable outboard motor support and lift which is inexpensive and versatile.

Accordingly, it is an object of the present invention to provide an improved portable outboard motor support and lift comprising a base, wheels, a first jack, a lift and a second jack.

More particularly, it is an object of the present invention to provide a base having a base exterior cylinder, a base interior cylinder, a left base, and a right base.

In keeping with these objects, and with others which will become apparent hereinafter, one feature of the present invention resides, briefly stated, in the base exterior cylinder comprising a base exterior cylinder pin, a base exterior cylinder bracket, and a base exterior cylinder opening.

When the base interior cylinder is designed in accordance with the present invention, the base interior cylinder comprises a base interior cylinder motor mount, a base interior cylinder bracket, a base interior cylinder bracket opening, and a base interior cylinder opening.

In accordance with another feature of the present invention, the left base comprises a left base front support and a left base back support.

Another feature of the present invention is that the right base comprises a right base front support and a right base back support.

Yet another feature of the present invention is that the first jack comprises a first jack piston, a first jack base, and a first jack pump.

Still another feature of the present invention is that the lift exterior comprises a lift exterior cylinder having a lift exterior cylinder opening, a lift interior cylinder having a lift interior cylinder first opening and a lift interior cylinder second opening and a lift interior cylinder upper opening lift interior cylinder lower opening Yet still another feature of the present invention is that the lift exterior further comprises a lift cylinder collar which comprises a lift cylinder collar upper bracket having a lift cylinder collar upper bracket opening, a lift cylinder collar lower bracket having a lift cylinder collar lower bracket opening, a lift cylinder collar first opening, and a lift cylinder collar second opening.

Still yet another feature of the present invention is that the lift exterior further comprises a lift arm exterior cylinder which comprises a lift arm exterior cylinder first opening, a lift arm exterior cylinder second opening, and a lift arm exterior cylinder bracket having a lift arm exterior cylinder bracket opening.

Another feature of the present invention is that the lift exterior further comprises a lift arm interior cylinder which comprises a lift arm interior cylinder first opening and a lift arm interior cylinder second opening.

Yet another feature of the present invention is that the lift further comprises a lift motor attachment means and a lift motor attachment means hook.

Still another feature of the present invention is that the second jack further comprises a second jack piston, a second jack base, and a second jack pump.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—improved portable outboard motor support and lift (10)
12—base (12)
12A—base exterior cylinder (12A)
12AA—base exterior cylinder pin (12AA)
12AB—base exterior cylinder bracket (12AB)
12AC—base exterior cylinder opening (12AC)
12B—base interior cylinder (12B)
12BA—base interior cylinder motor mount (12BA)
12BB—base interior cylinder bracket (12BB)
12BBA—base interior cylinder bracket opening (12BBA)
12BC—base interior cylinder opening (12BC)
12L—left base (12L)
12LF—left base front support (12LF)

12LB—left base back support (12LB)
12R—right base (12R)
12RF—right base front support (12RF)
12RB—right base back support (12RB)
14LF—left front wheel (14LF)
14LR—left rear wheel (14LR)
14RF—right front wheel (14RF)
14RR—right rear wheel (14RR)
16—first jack (16)
16A—first jack piston (16A)
16B—first jack base (16B)
16C—first jack pump (16C)
18—lift (18)
18A—lift exterior cylinder (18A)
18AA—lift exterior cylinder opening (18AA)
18B—lift interior cylinder (18B)
18BA—lift interior cylinder first opening (18BA)
18BB—lift interior cylinder second opening (18BB)
18BU—lift interior cylinder upper opening (18BU)
18BL—lift interior cylinder lower opening (18BL)
18C—lift cylinder collar (18C)
18CU—lift cylinder collar upper bracket (18CU)
18CUA—lift cylinder collar upper bracket opening (18CUA)
18CL—lift cylinder collar lower bracket (18CL)
18CLA—lift cylinder collar lower bracket opening (18CLA)
18CA—lift cylinder collar first opening (18CA)
18CB—lift cylinder collar second opening (18CB)
18D—lift arm exterior cylinder (18D)
18DA—lift arm exterior cylinder first opening (18DA)
18DB—lift arm exterior cylinder second opening (18DB)
18DC—lift arm exterior cylinder bracket (18DC)
18DCA—lift arm exterior cylinder bracket opening (18DCA)
18E—lift arm interior cylinder (18E)
18EA—lift arm interior cylinder first opening (18EA)
18EB—lift arm interior cylinder second opening (18EB)
18F—lift motor attachment means (18F)
18FA—lift motor attachment means hook (18FA)
20—second jack (20)
20A—second jack piston (20A)
20B—second jack base (20B)
20C—second jack pump (20C)
22—fastener (22)
24—pivot pin (24)

DESCRIPTION OF THE PREFERRED EMBODIMENT

Figure 1:
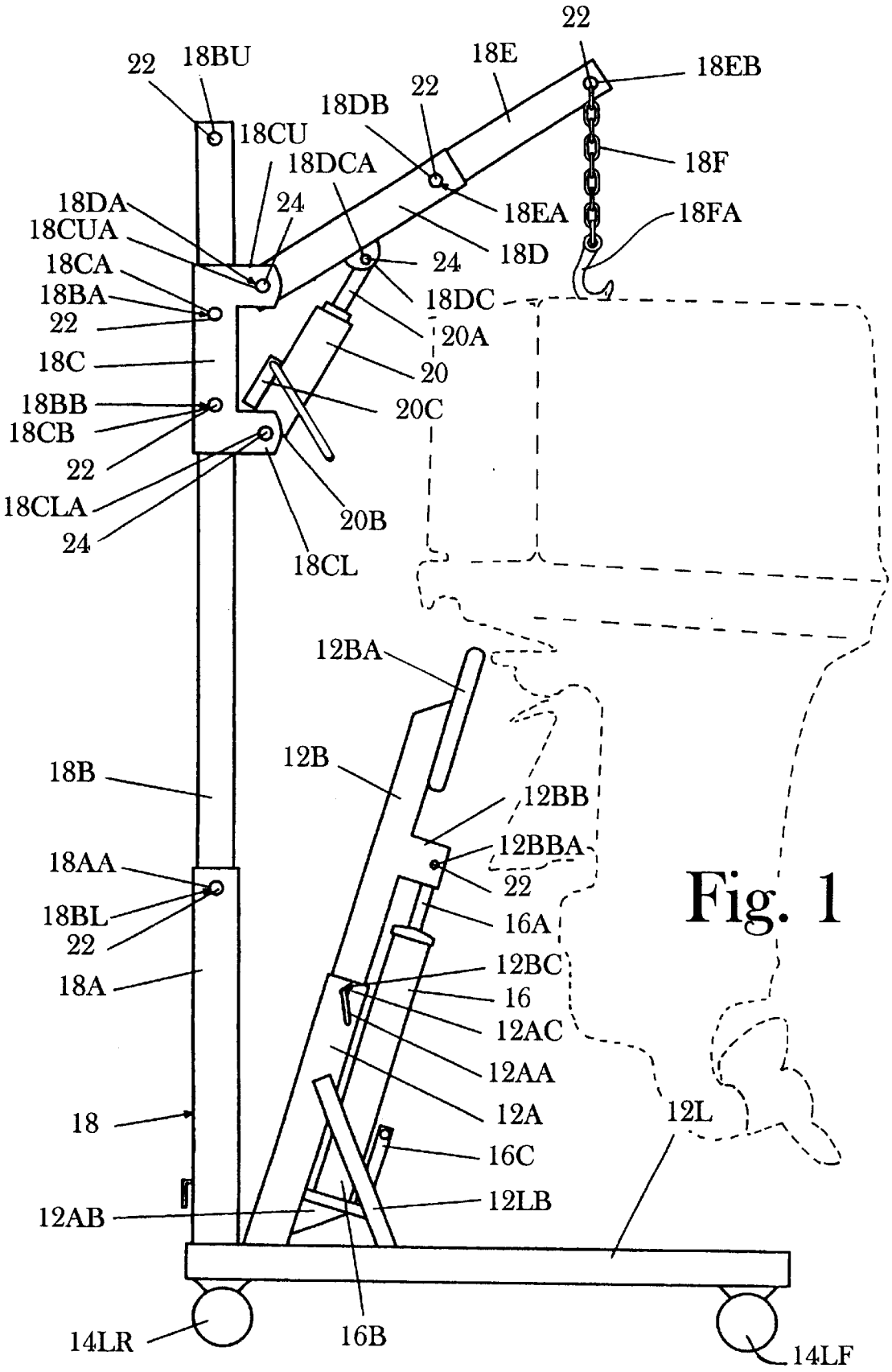
FIG. 1 is a left side view of a improved portable outboard motor support and lift.
Figure 2:
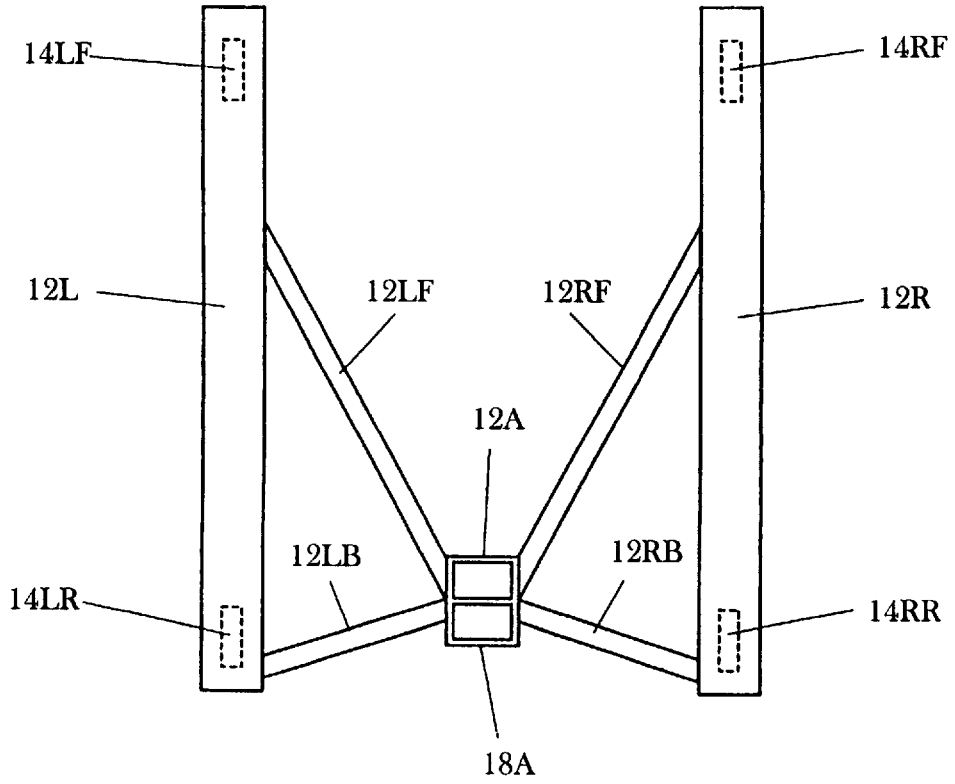
FIG. 2 is a bottom view of a base exhibiting a lift exterior cylinder attached thereto.

Firstly, referring to FIG. 1 which is a left side view of a improved portable outboard motor support and lift (10). Referring to FIG. 2 which is a bottom view of a base (12) exhibiting a lift exterior cylinder (18A) attached thereto. The improved portable outboard motor support and lift (10) comprises a base (12) which comprises a left base (12L) and a right base (12R). The base (12) further comprises a base exterior cylinder (12A) securely attached at a bottom end thereto, a base interior cylinder (12B) is movably positioned within the base exterior cylinder (12A). The base interior cylinder (12B) further comprises a base interior cylinder motor mount (12BA) securely attached at an upper distal end. The base exterior cylinder (12A) further comprises a base exterior cylinder pin (12AA) removably insertable through a base exterior cylinder opening (12AC) and a base interior cylinder opening (12BC) functioning to securely attach the base exterior cylinder (12A) to the base interior cylinder (12B). The base exterior cylinder (12A) further comprises a base exterior cylinder bracket (12AB) to which the first jack base (16B) is securely attached. The base interior cylinder (12B) further comprises base interior cylinder bracket (12BB) to which the first jack piston (16A) is securely attached. The cylinder bracket (12BB) comprises a base interior cylinder bracket opening (12BBA) to which the first jack piston (16A) is pivotally mounted thereto by a fastener (22). The left base (12L) further comprises a left base front support (12LF) securely attached to the base exterior cylinder (12A) and the right base (12R) further comprises a right base front support (12RF) securely attached to the base exterior cylinder (12A). The left base (12L) further comprises a left base back support (12LB) securely attached to the base exterior cylinder (12A) and the right base (12R) further comprises a right base back support (12RB) securely attached to the base exterior cylinder (12A). The left base (12L) further comprises a left base front support (12LF) securely attached to the base exterior cylinder (12A) and the right base (12R) further comprises a right base front support (12RF) securely attached to the base exterior cylinder (12A) and the left base (12L) further comprises a left base back support (12LB) securely attached to the base exterior cylinder (12A) and the right base (12R) further comprises a right base back support (12RB) securely attached to the base exterior cylinder (12A) which function in unison to add additional support strength thereto. The left base (12L) further comprises a left rear wheel (14LR) and the right base (12R) further comprises a right rear wheel (14RR). The left base (12L) further comprises a left front wheel (14LF) and the right base (12R) further comprises a right front wheel (14RF). The improved portable outboard motor support and lift (10) comprises a first jack (16) comprises a first jack piston (16A) securely attached to the base interior cylinder (12B) and a first jack base (16B) securely attached to the base exterior cylinder (12A). The base exterior cylinder (12A) is at an angle in the range from 10° to 20° relative to the left base (12L) and the right base (12R). The first jack (16) further comprises a first jack pump (16C) which functions to increase pressure within the first jack base (16B) extending the first jack piston (16A) upwardly which concurrently extends the base interior cylinder (12B) upwardly.

The improved portable outboard motor support and lift (10) further comprises a lift (18) which comprises a lift exterior cylinder (18A) having at least one lift exterior cylinder opening (18AA) therethrough. The lift exterior cylinder (18A) is securely attached at a lower end to the base (12). The lift (18) further comprises a lift interior cylinder (18B) having at least one lift interior cylinder upper opening (18BU) and at least one lift interior cylinder lower opening (18BL) therethrough. The lift interior cylinder (18B) is movably positioned within the lift exterior cylinder (18A). The improved portable outboard motor support and lift (10) further comprises at least one fastener (22) is positioned through the at least one lift exterior cylinder opening (18AA) and the at least one lift interior cylinder lower opening (18BL) functioning to securely fasten the lift exterior cylinder (18A) to the lift interior cylinder (18B). An inner distal end of a lift arm exterior cylinder (18D) is pivotally mounted to the lift interior cylinder (18B). The lift arm exterior cylinder (18D) comprises a lift motor attachment means (18F) securely attached at an outer distal end. An outboard engine is attached to a lower end of the lift motor attachment means (18F). The lift interior cylinder (18B) further comprises a lift cylinder collar (18C) which comprises a lift cylinder collar upper bracket (18CU) having a lift cylinder collar upper bracket opening (18CUA) therethrough and a lift cylinder collar lower bracket (18CL) having a lift cylinder collar lower bracket opening (18CLA) therethrough and at least one lift cylinder collar opening (18CA, 18CB) therethrough. The lift interior cylinder (18B) further comprises at least one lift interior cylinder opening (18BA, 18BB) therethrough. At least one fastener (22) is positioned through the at least one lift cylinder collar opening (18CA, 18CB) and the at least one lift interior cylinder opening (18BA, 18BB) functioning as a height adjustment means. The lift arm exterior cylinder (18D) further comprises a lift arm exterior cylinder first opening (18DA) and a lift arm exterior cylinder second opening (18DB) therethrough. The lift arm exterior cylinder (18D) is pivotally mounted to the lift cylinder collar upper bracket (18CU) by a pivot pin (24) through the lift arm exterior cylinder first opening (18DA) and the lift cylinder collar upper bracket opening (18CUA). The lift cylinder collar upper bracket (18CU) is pivotally connected to the second jack base (20B) by a pivot pin (24). The lift arm exterior cylinder (18D) further comprises a lift arm exterior cylinder bracket (18DC) having a lift arm exterior cylinder bracket opening (18DCA) therethrough. The second jack piston (20A) is pivotally connected to the lift arm exterior cylinder bracket (18DC) by a pivot pin (24) positioned through the lift arm exterior cylinder bracket opening (18DCA). A lift arm interior cylinder (18E) movably mounted within the lift arm exterior cylinder (18D). The lift arm interior cylinder (18E) further comprises at least one lift arm interior cylinder opening (18EA). A fastener (22) is positioned through the at least one lift arm interior cylinder opening (18EA) and the lift arm exterior cylinder second opening (18DB) functioning to securely attach the lift arm exterior cylinder (18D) to the lift arm interior cylinder (18E). The lift arm interior cylinder (18E) further comprises a lift arm interior cylinder second opening (18EB) having the lift motor attachment means (18F) securely positioned therethrough. The lift motor attachment means (18F) further comprises a lift motor attachment means hook (18FA) securely attached to a bottom distal end.

The improved portable outboard motor support and lift (10) further comprises a second jack (20) comprises a second jack piston (20A) securely attached to the lift arm exterior cylinder (18D) and a second jack base (20B) securely attached to the lift interior cylinder (18B). The second jack (20) further comprises a second jack pump (20C) which functions to increase pressure within the second jack base (20B) extending the second jack piston (20A) upwardly which concurrently extends the lift arm exterior cylinder (18D) upwardly listing an engine.

The improved portable outboard motor support and lift (10) as described in claim 1 is manufactured from a material selected from a group consisting of metal, metal alloy, plastic, plastic composite, rubber, rubber composite, and wood.

It will be understood that each of the elements described above, or two or more together, may also find a useful application in other types of constructions differing from the type described above.

While the invention has been illustrated and described as embodied in portable outboard motor support and lift, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improved portable outboard motor support and lift (10) comprising:

A) a base (12) which comprises a left base (12L) and a right base (12R), the base (12) further comprises a base exterior cylinder (12A) securely attached at a bottom end thereto, a base interior cylinder (12B) is movably positioned within the base exterior cylinder (12A), the base interior cylinder (12B) further comprises a base interior cylinder motor mount (12BA) securely attached at an upper distal end;

B) a first jack (16) comprises a first jack piston (16A) securely attached to the base interior cylinder (12B) and a first jack base (16B) securely attached to the base exterior cylinder (12A), the first jack (16) further comprises a first jack pump (16C) which functions to increase pressure within the first jack base (16B) extending the first jack piston (16A) upwardly which concurrently extends the base interior cylinder (12B) upwardly;

C) a lift (18) comprises a lift exterior cylinder (18A) having at least one lift exterior cylinder opening (18AA) therethrough, the lift exterior cylinder (18A) is securely attached at a lower end to the base (12), the lift (18) further comprises a lift interior cylinder (18B) having at least one lift interior cylinder upper opening (18BU) and at least one lift interior cylinder lower opening (18BL) therethrough, the lift interior cylinder (18B) is movably positioned within the lift exterior cylinder (18A), at least one fastener (22) is positioned through the at least one lift exterior cylinder opening (18AA) and the at least one lift interior cylinder lower opening (18BL) functioning to securely fasten the lift exterior cylinder (18A) to the lift interior cylinder (18B), an inner distal end of a lift arm exterior cylinder (18D) is pivotally mounted to the lift interior cylinder (18B), the lift arm exterior cylinder (18D) comprises a lift motor attachment means (18F) securely attached at an outer distal end, an outboard engine is attached to a lower end of the lift motor attachment means (18F); and D) a second jack (20) comprises a second jack piston (20A) securely attached to the lift arm exterior cylinder (18D) and a second jack base (20B) securely attached to the lift interior cylinder (18B), the second jack (20) further comprises a second jack pump (20C) which functions to increase pressure within the second jack base (20B) extending the second jack piston (20A) upwardly which concurrently extends the lift arm exterior cylinder (18D) upwardly lifting the engine.

2. The improved portable outboard motor support and lift (10) as described in claim 1, wherein the base exterior cylinder (12A) further comprises a base exterior cylinder pin (12AA) removably insertable through a base exterior cylinder opening (12AC) and a base interior cylinder opening (12BC) functioning to securely attach the base exterior cylinder (12A) to the base interior cylinder (12B).

3. The improved portable outboard motor support and lift (10) as described in claim 1, wherein the base exterior cylinder (12A) further comprises a base exterior cylinder bracket (12AB) to which the first jack base (16B) is securely attached.

4. The improved portable outboard motor support and lift (10) as described in claim 1, wherein the base interior cylinder (12B) further comprises base interior cylinder bracket (12BB) to which the first jack piston (16A) is securely attached.

5. The improved portable outboard motor support and lift (10) as described in claim 4, wherein the cylinder bracket (12BB) comprises a base interior cylinder bracket opening (12BBA) to which the first jack piston (16A) is pivotally mounted thereto by a fastener (22).

6. The improved portable outboard motor support and lift (10) as described in claim 1, wherein the left base (12L) further comprises a left base front support (12LF) securely attached to the base exterior cylinder (12A) and the right base (12R) further comprises a right base front support (12RF) securely attached to the base exterior cylinder (12A).

7. The improved portable outboard motor support and lift (10) as described in claim 1, wherein the left base (12L) further comprises a left base back support (12LB) securely attached to the base exterior cylinder (12A) and the right base (12R) further comprises a right base back support (12RB) securely attached to the base exterior cylinder (12A).

8. The improved portable outboard motor support and lift (10) as described in claim 6, wherein the left base (12L) further comprises the left base front support (12LF) securely attached to the base exterior cylinder (12A) and the right base (12R) further comprises the right base front support (12RF) securely attached to the base exterior cylinder (12A) and the left base (12L) further comprises a left base back support (12LB) securely attached to the base exterior cylinder (12A) and the right base (12R) further comprises a right base back support (12RB) securely attached to the base exterior cylinder (12A) which function in unison to add additional support strength thereto.

9. The improved portable outboard motor support and lift (10) as described in claim 1, wherein the left base (12L) further comprises a left rear wheel (14LR) and the right base (12R) further comprises a right rear wheel (14RR).

10. The improved portable outboard motor support and lift (10) as described in claim 9, wherein the left base (12L) further comprises a left front wheel (14LF) and the right base (12R) further comprises a right front wheel (14RF).

11. The improved portable outboard motor support and lift (10) as described in claim 1, wherein the lift interior cylinder (18B) further comprises a lift cylinder collar (18C) which comprises a lift cylinder collar upper bracket (18CU) having a lift cylinder collar upper bracket opening (18CUA) therethrough and a lift cylinder collar lower bracket (18CL) having a lift cylinder collar lower bracket opening (18CLA) therethrough and at least one lift cylinder collar opening (18CA, 18CB) therethrough, the lift interior cylinder (18B) further comprises at least one lift interior cylinder opening (18BA, 18BB) therethrough, at least one fastener (22) is positioned through the at least one lift cylinder collar opening (18CA, 18CB) and the at least one lift interior cylinder opening (18BA, 18BB) functioning as a height adjustment means.

12. The improved portable outboard motor support and lift (10) as described in claim 11, wherein the lift arm exterior cylinder (18D) further comprises a lift arm exterior cylinder first opening (18DA) and a lift arm exterior cylinder second opening (18DB) therethrough, the lift arm exterior cylinder (18D) is pivotally mounted to the lift cylinder collar upper bracket (18CU) by a pivot pin (24) through the lift arm exterior cylinder first opening (18DA) and the lift cylinder collar upper bracket opening (18CUA).

13. The improved portable outboard motor support and lift (10) as described in claim 11, wherein the lift cylinder collar upper bracket (18CU) is pivotally connected to the second jack base (20B) by a pivot pin (24).

14. The improved portable outboard motor support and lift (10) as described in claim 1, wherein the lift arm exterior cylinder (18D) further comprises a lift arm exterior cylinder bracket (18DC) having a lift arm exterior cylinder bracket opening (18DCA) therethrough, the second jack piston (20A) is pivotally connected to the lift arm exterior cylinder bracket (18DC) by a pivot pin (24) positioned through the lift arm exterior cylinder bracket opening (18DCA).

15. The improved portable outboard motor support and lift (10) as described in claim 1 further comprises a lift arm interior cylinder (18E) movably mounted within the lift arm exterior cylinder (18D), the lift arm interior cylinder (18E) further comprises at least one lift arm interior cylinder opening (18EA), a fastener (22) is positioned through the at least one lift arm interior cylinder opening (18EA) and the lift arm exterior cylinder second opening (18DB) functioning to securely attach the lift arm exterior cylinder (18D) to the lift arm interior cylinder (18E).

16. The improved portable outboard motor support and lift (10) as described in claim 15, wherein the lift arm interior cylinder (18E) further comprises a lift arm interior cylinder second opening (18EB) having the lift motor attachment means (18F) securely positioned therethrough.

17. The improved portable outboard motor support and lift (10) as described in claim 1, wherein the lift motor attachment means (18F) further comprises a lift motor attachment means hook (18FA) securely attached to a bottom distal end.

18. The improved portable outboard motor support and lift (10) as described in claim 1, wherein the base exterior cylinder (12A) is at an angle range from 10° to 20° relative to the left base (12L) and the right base (12R).

19. The improved portable outboard motor support and lift (10) as described in claim 1 is manufactured from a material selected from a group consisting of metal, metal alloy, plastic, plastic composite, rubber, rubber composite, and wood.

* * * * *